US010145582B2

(12) United States Patent
Yamaguchi et al.

(10) Patent No.: US 10,145,582 B2
(45) Date of Patent: Dec. 4, 2018

(54) INDOOR UNIT FOR AIR CONDITIONING DEVICE

(71) Applicant: DAIKIN INDUSTRIES, LTD., Osaka-shi, Osaka (JP)

(72) Inventors: Motonari Yamaguchi, Sakai (JP); Miki Yamada, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 1064 days.

(21) Appl. No.: 14/374,603

(22) PCT Filed: Feb. 5, 2013

(86) PCT No.: PCT/JP2013/052539
§ 371 (c)(1),
(2) Date: Jul. 25, 2014

(87) PCT Pub. No.: WO2013/121920
PCT Pub. Date: Aug. 22, 2013

(65) Prior Publication Data

US 2015/0016808 A1 Jan. 15, 2015

(30) Foreign Application Priority Data

Feb. 15, 2012 (JP) ..... 2012-030518

(51) Int. Cl.
*F24H 9/02* (2006.01)
*F24F 13/20* (2006.01)
(Continued)

(52) U.S. Cl.
CPC ..... *F24H 9/02* (2013.01); *F24F 1/0007* (2013.01); *F24F 13/20* (2013.01); *F24H 3/022* (2013.01); *F24H 9/06* (2013.01); *F28F 13/12* (2013.01)

(58) Field of Classification Search
CPC ..... F24F 13/20; F24F 1/0007; F28F 13/12; F24H 9/02; F24H 9/06; F24H 3/022
(Continued)

(56) References Cited

U.S. PATENT DOCUMENTS 4,470,271 A * 9/1984 Draper ..... F24F 1/16 165/124
4,724,281 A * 2/1988 Nix ..... H02G 3/088 174/53
(Continued)

FOREIGN PATENT DOCUMENTS

JP 6-337131 A 12/1994
JP 11-316039 A 11/1999
(Continued)

OTHER PUBLICATIONS

Machine translation of JP2009127991 (Yokoyama, also listed in the IDS of Jul. 25, 2014).*

*Primary Examiner* — Thien S Tran
(74) *Attorney, Agent, or Firm* — Birch, Stewart, Kolasch & Birch, LLP

(57) ABSTRACT

An indoor unit for an air conditioning device that can increase the strength of a casing of the indoor unit, increase the stability of the indoor unit, and promote cooling of an electric component is disclosed. The indoor unit for the air conditioning device includes a casing formed with an intake air port in a lower portion thereof, and formed with an exhaust air port in an upper portion thereof, a fan arranged inside the casing, and generating air flow from the intake port to the exhaust port, a heat exchanging device arranged below the fan inside the casing to exchange heat with the air taken into the casing from the intake port, and an electric component case provided at a position adjacent to a lateral
(Continued)

side of the fan in a circulation space of the air in the casing and configured as a strengthening member of the casing.

6 Claims, 6 Drawing Sheets

(51) Int. Cl.

| | |
|---|---|
| ***F24F 1/00*** | (2011.01) |
| ***F24H 3/02*** | (2006.01) |
| ***F24H 9/06*** | (2006.01) |
| ***F28F 13/12*** | (2006.01) |

(58) Field of Classification Search
USPC ..... 392/360; 165/121
See application file for complete search history.

(56) References Cited

U.S. PATENT DOCUMENTS

| | | | | |
|---|---|---|---|---|
| 5,967,411 | A | 10/1999 | Perry et al. | |
| 6,149,066 | A | 11/2000 | Perry et al. | |
| 8,701,431 | B2 * | 4/2014 | Jeung | F24F 1/06 62/259.1 |
| 2005/0172658 | A1 * | 8/2005 | Zuckerman | F24F 1/04 62/424 |
| 2010/0218919 | A1 * | 9/2010 | Shibata | F24F 12/006 165/104.34 |

FOREIGN PATENT DOCUMENTS

| | | | |
|---|---|---|---|
| JP | 2006-138573 | A * | 6/2006 |
| JP | 2009-127991 | A | 6/2009 |
| JP | 2010-121858 | A | 6/2010 |
| JP | 2010-159906 | A | 7/2010 |

* cited by examiner

INDOOR UNIT FOR AIR CONDITIONING DEVICE

TECHNICAL FIELD

The present invention relates to an indoor unit for an air conditioning device.

BACKGROUND ART

In Patent Literature 1, an air conditioning device utilizing a heat pump is disclosed. This air conditioning device includes an indoor unit including a casing, a heat exchanger disposed in a lower portion inside the casing, and a fan arranged above the heat exchanger inside the casing. In a lower surface of the casing of this indoor unit, an air intake port is formed, and in an upper portion of the casing, an exhaust port of the air is formed. Moreover, a controller that controls the whole indoor unit is provided at a position adjacent to the exhaust port of the air. Furthermore, a heater that is electrically operated is provided at the exhaust port to support the heat pump during heating operation.

CITATION LIST

Patent Literature

Patent Literature 1: Japanese Unexamined Patent Publication No. H11-316039

SUMMARY OF INVENTION

Technical Problem

The controller incorporated in the indoor unit may have a weight of about 10 to 15 kg, and provision of the controller in the upper portion of the casing makes a center of gravity of the indoor unit high. Particularly, in the longitudinal indoor unit in which the heat exchanger and the fan are disposed side by side in a vertical direction, the provision of the controller in the upper portion of the casing easily deteriorates stability. Moreover, more increase in strength of the casing has been demanded to support heavy units such as the controller, the fan and the like more strongly.

Meanwhile, when the fan is inverter-controlled, the controller is provided with a power element generating a large amount of heat. However, since the controller of Patent Literature 1 is arranged in a space adjacent to the exhaust port of the air, where the air does not circulate, the heat-generating component cannot be sufficiently cooled. Furthermore, when the heater is provided at the exhaust port of the air, the controller is easily affected by the heat of the heater, which may cause failure of the controller.

The present invention is achieved in light of the above-described situations, and an object of the present invention is to provide an indoor unit for an air conditioning device that can increase strength of a casing and increase stability of the indoor unit, and in addition, promote cooling of a controller (an electric component).

Solution to Problem

An indoor unit for an air conditioning device according to the present invention includes: a casing formed with an intake port of air in a lower portion thereof, and an exhaust port of the air in an upper portion thereof; a fan arranged inside the casing, and generating an air flow flowing from the intake port to the exhaust port; a heat exchanging device arranged below the fan inside the casing to exchange heat with the air taken into the casing from the intake port; and an electric component supporting member to support an electric component, wherein the electric component supporting member is provided at a position adjacent to a lateral side of the fan in a circulation space of the air inside the casing, and is configured as a strengthening member of the casing.

According to the indoor unit for the air conditioning device according to the present invention, since the electric component supporting member is arranged adjacent to the fan, a center of gravity of the indoor unit is lowered, which can increase stability, and further, since the electric component supporting member is configured as the strengthening member of the casing, strength of the casing can be increased efficiently. Moreover, since the electric component supporting member is arranged in the circulation space of the air, cooling of the electric component, which includes a heat-generating component and which is supported by the electric component supporting member, can be promoted.

It is preferable that in the above-described indoor unit, a detachable first side wall is provided in one side surface of the casing, and the electric component supporting member is arranged closely to the one side surface of the casing closed by the first side wall and is configured detachably from the casing.

According to this configuration, detaching the first side wall from the one side surface of the casing enables operation, inspection and the like of the electric component supported by the electric component supporting member, and further, detaching the electric component supporting member from the casing enables inspection, exchange and the like for the fan.

It is preferable that a space for temporarily placing the electric component supporting member detached from the casing is formed in an upper portion of the casing.

The above-described configuration allows the electric component supporting member detached from the casing to be temporarily placed in the upper portion of the casing, and can prevent the electric component supporting member from disturbing maintenance or the like of the fan.

It is preferable that the casing includes a second side wall and a third side wall arranged to be opposed to each other, two reinforcement members spaced in a vertical direction are constructed across the second side wall and the third side wall, and an upper portion and a lower portion of the electric component supporting member are coupled to the upper reinforcement member and the lower reinforcement member, respectively.

The above-described configuration allows the electric component supporting member to function as the strengthening member receiving a load in the vertical direction between the upper and the lower reinforcement members.

It is preferable that the electric component supporting member is formed into a box shape.

The above-described configuration can increase strength of the electric component supporting member itself, and can also increase the function as the strengthening member of the casing.

It is preferable that the electric component supporting member has a bottom plate and side plates extending upward from this bottom plate, and at a lower end of each of the side plates, a folded portion making a surface contact with an upper surface of the bottom plate is provided.

The above-described configuration allows a load to be received by the surface contact between the bottom plate and the folded portions of the side walls when the load pushing up from below is applied to the electric component supporting member, which can increase the strength of the electric component supporting member itself.

It is preferable that the electric component supporting member includes a locking portion that locks the electric component supporting member to the upper reinforcement member in a suspended state.

The above-described configuration allows positioning, temporary joint or the like to the upper reinforcement member to be easily performed.

A heater may be provided in the vicinity of the exhaust port.

The above-described configuration distances, from the heater, the electric component supported by the electric component supporting member, so that the electric component can be prevented from being thermally affected by the heater.

Advantageous Effects of Invention

According to the indoor unit for the air conditioning device of the present invention, the strength of the casing can be increased, and stability of the indoor unit can also be increased, and in addition, the cooling of the electric component can be promoted.

DESCRIPTION OF EMBODIMENTS

Hereinafter, an embodiment of the present invention will be described with reference to the drawings.

Figure 1:
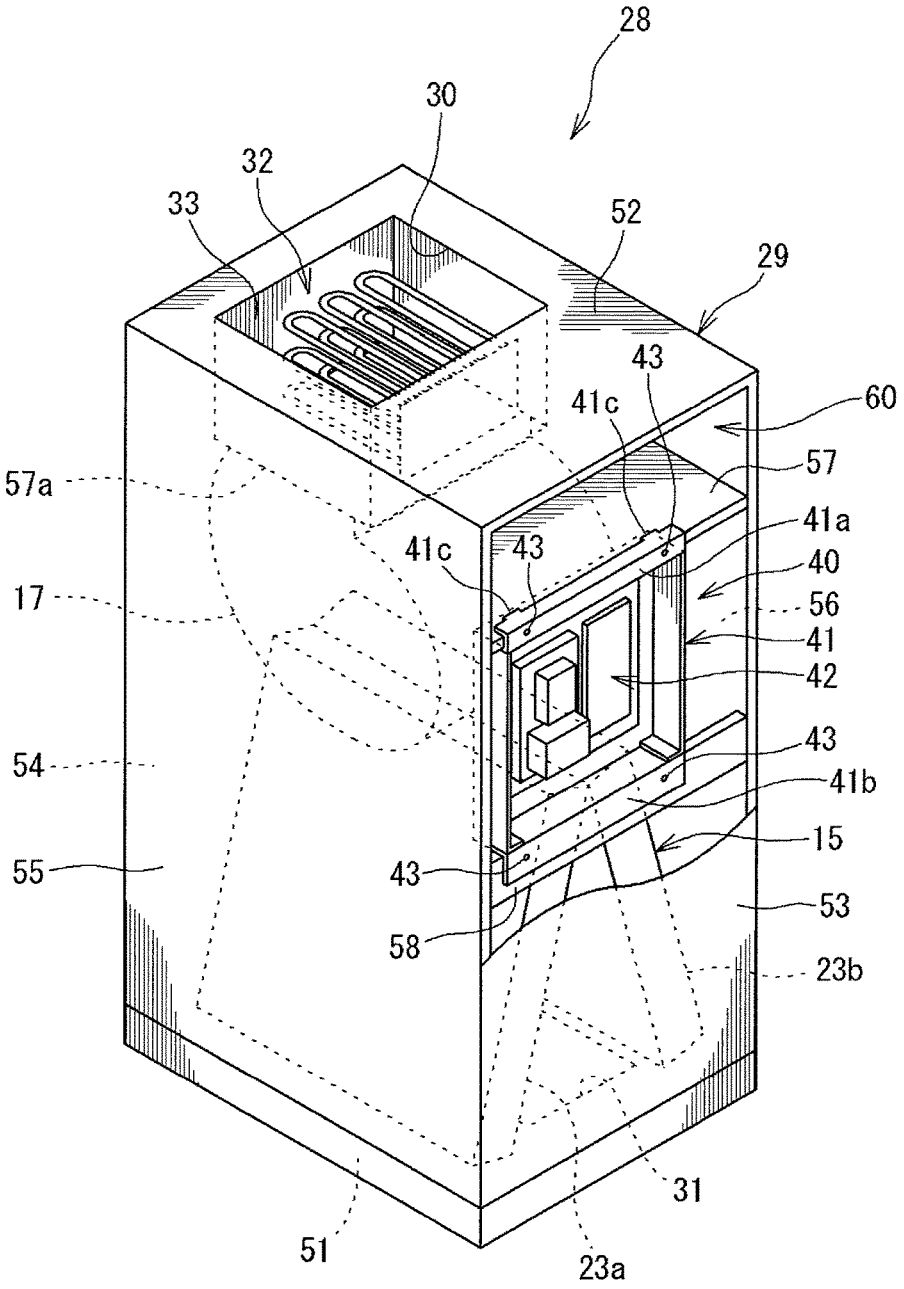
FIG. 1 is a perspective view in which a part of an indoor unit for an air conditioning device according to one embodiment of the present invention is fractured.
Figure 2:
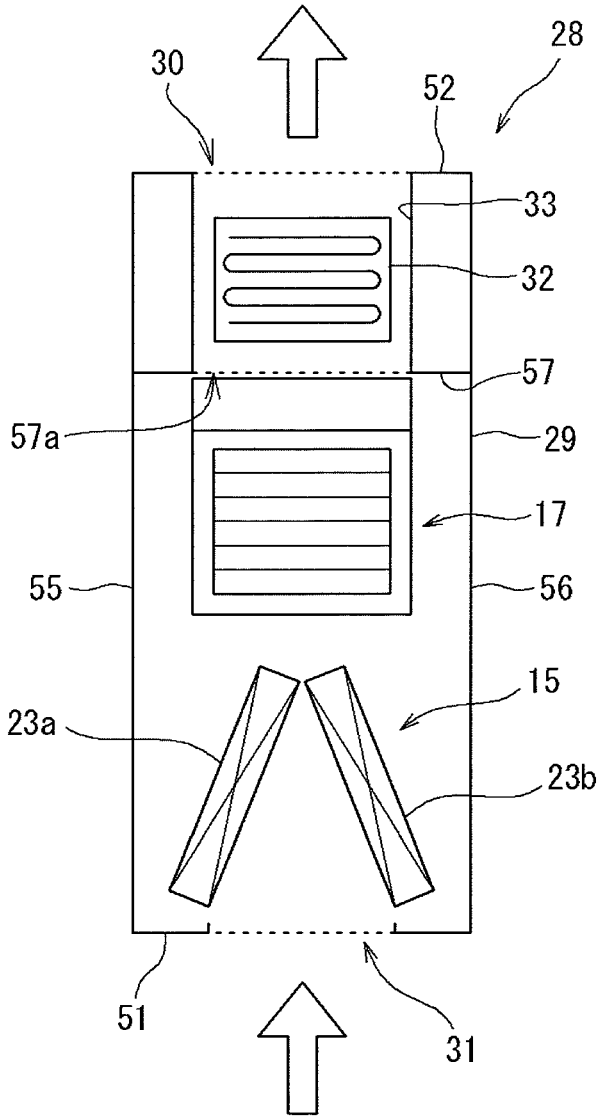
FIG. 2 is a schematic front view of the indoor unit.
Figure 3:
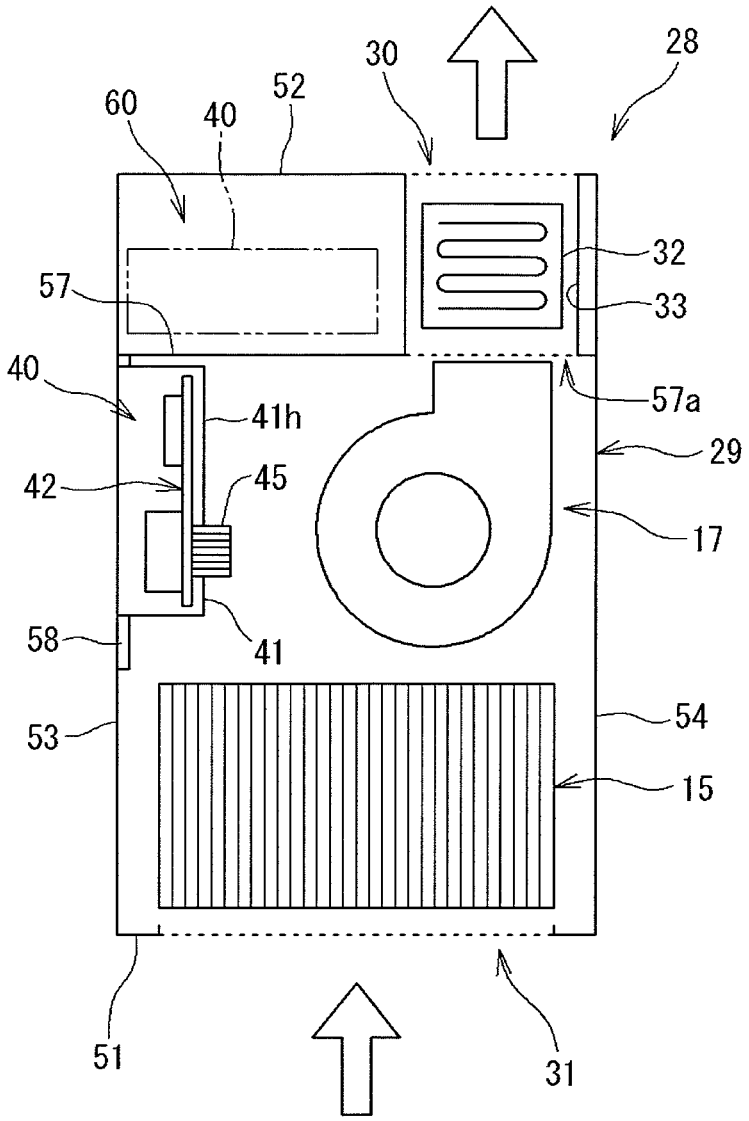
FIG. 3 is a schematic side view of the indoor unit.

FIG. 1 is a perspective view in which a part of an indoor unit for an air conditioning device according to one embodiment of the present invention is fractured, FIG. 2 is a schematic front view of the indoor unit, and FIG. 3 is a schematic side view of the indoor unit.

An indoor unit 28 in an air conditioning device of the present embodiment includes a casing 29, a heat exchanging device 15, a fan 17, a heater 32, an electric component unit 40 and the like. The casing 29 has a bottom plate 51, a top plate 52, front and back side walls 53, 54, and right and left side walls 55, 56, and is formed into a substantially parallelepiped box shape. The bottom plate 51 is formed with an intake port 31 of air, and the top plate 52 is formed with an exhaust port 30 of the air. Inside the casing 29, an internal plate 57 is provided at a distance below the top plate 52, and a space inside the casing 29 below this internal plate 57 is a circulation space of the air. Moreover, the internal plate 57 is formed with an opening 57*a* similar to the exhaust port 30, and this opening 57*a* and the exhaust port 30 are connected through a square cylinder-shaped exhaust passage 33. A space excluding this exhaust passage 33 between the top plate 52 and the internal plate 57 is a temporary-placement space 60 of the electric component unit 40 described later.

The heat exchanging device 15 is arranged in a lower stage portion of the casing 29, and the fan 17 is arranged in an intermediate stage portion inside the casing 29 above the heat exchanging device 15. The fan 17 is made of a sirocco fan or the like, and is configured so as to suck the air from a side surface thereof and blow the air upward. The fan 17 is supported by the internal plate 57, and a blowing port thereof is connected to the exhaust passage 33. The fan 17 is activated to thereby generate an air flow flowing from the intake port 31 to the exhaust port 30.

The heat exchanging device 15 functions as an evaporator during cooling operation, and functions as a condenser during heating operation to exchange heat with the air taken in from the intake port 31. The heat exchanging device 15 includes two heat exchangers 23*a*, 23*b*. These heat exchangers 23*a*, 23*b* are arranged horizontally symmetrically so as to be inclined in opposite directions to each other, and form into a substantial A shape as a whole. The intake port 31 of the air formed in the bottom plate 51 is formed between the two heat exchangers 23*a*, 23*b*.

The casing 29 is placed on trestles not shown or the like, which enables the air to be taken in from the intake port 31. Alternatively, ducts not shown may be connected to the intake port 31 and the exhaust port 30, and the air at a remote place can be sucked through this duct, and the air whose temperature and the like are adjusted can be exhausted to a remote place.

Figure 4:
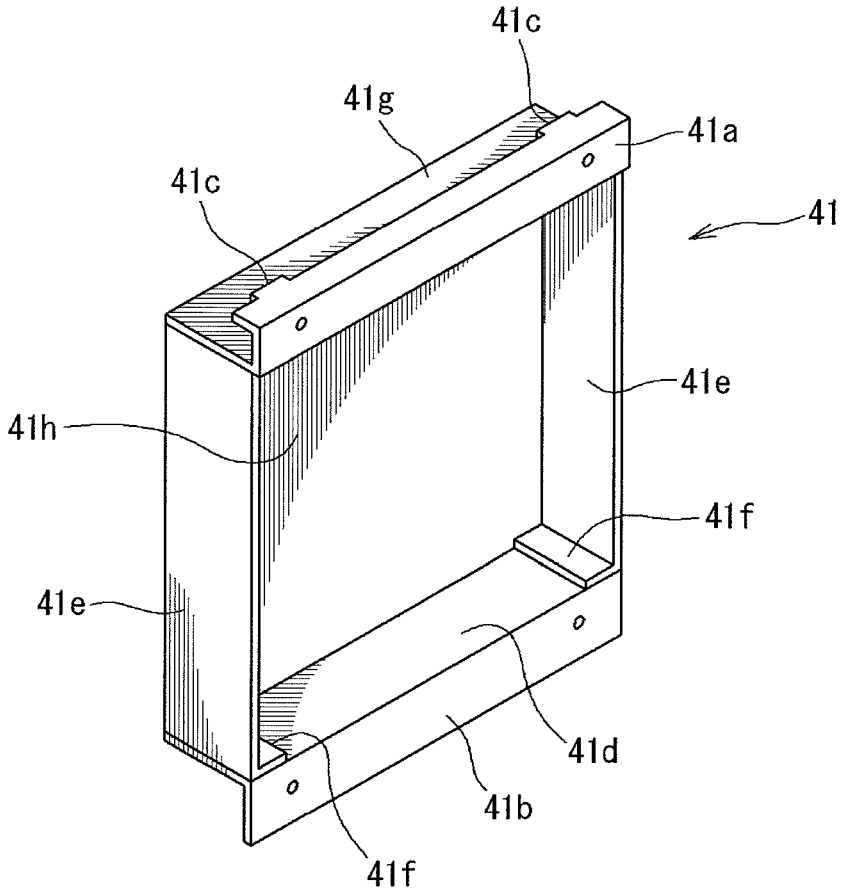
FIG. 4 is a perspective view of an electric component case.

The electric component unit 40 contains an electric component 42 including a control board and various terminals inside an electric component case (an electric component supporting member) 41, and is arranged in the vicinity of an inner side of the front wall (a first side wall) 53 of the casing 29. As shown in FIG. 4, the electric component case 41 is formed into a box shape open on the front side, and has a bottom plate 41*d*, right and left side plates 41*e*, a top plate 41*g*, and a back plate 41*h*. Moreover, the electric component unit 40 is arranged in the intermediate stage portion inside the casing 29 as with the fan 17, and is arranged adjacent to, and in front of the fan 17.

The front wall 53 of the casing 29 is detachable from the side walls 55, 56 and the like making up the casing 29, and the detachment allows an inside of the electric component case 41 to be exposed outside, and enables operation and inspection of the electric component 42 to be performed. Moreover, the electric component case 41 can be detached from the casing 29, and the detachment enables inspection, exchange and the like of the fan 17 at the back to be performed from a front surface side of the casing 29.

In a front surface of the casing 29, upper and lower reinforcement members 57, 58 constructed across the right and the left side walls (second and third side walls) 55, 56 are provided. The upper reinforcement member is made of the aforementioned internal plate 57. The lower reinforcement member 58 is formed into a band-plate shape long in a right-left direction, and is arranged almost between the heat exchanging device 15 and the fan 17 in a height direction.

Meanwhile, as shown in FIGS. 1 and 4, in an upper edge on a front surface of the electric component case 41, an attachment plate 41*a* bent upward is provided, and in a lower edge, an attachment plate 41*b* bent downward is provided. The upper and the lower attachment plates 41*a*, 41*b* are detachably fixed by attachment bolts 43 in a state abutting on front surfaces of the upper and the lower reinforcement members 57, 58, respectively.

Figure 5:
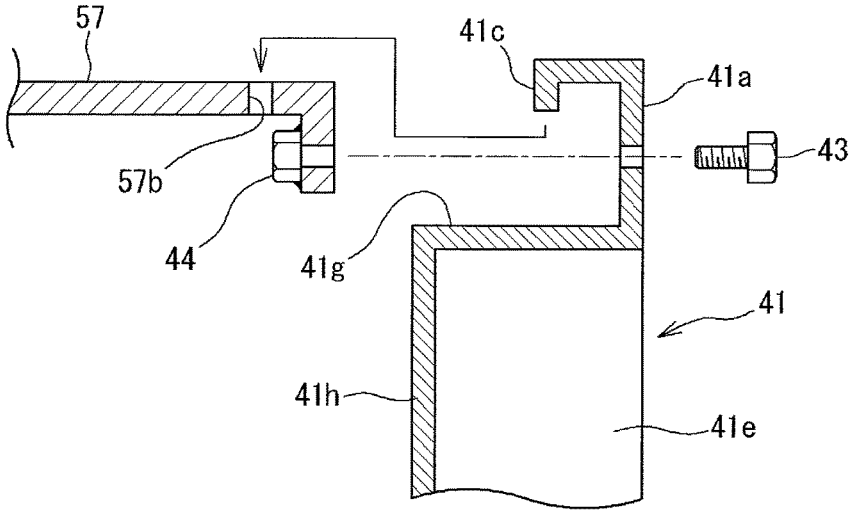
FIG. 5 is a cross-sectional view showing a coupling structure of the electric component case and a casing.

Moreover, at a plurality of positions (two positions in a shown example) in the right-left direction in the upper attachment plate 41*a*, locking hooks (locking portions) 41*c* are provided. These locking hooks 41*c* are inserted into slits 57*b* formed in the internal plate 57 to thereby lock the electric component case 41 to the internal plate 57, as shown in FIG. 5. Accordingly, the electric component case 41 is supported in a state suspended from the internal plate 57 by the locking hooks 41*c* even if the attachment bolts 43 are removed. Moreover, in a front end portion of the internal plate 57, nuts 44 into which the attachment bolts 43 are screwed are provided.

As shown in FIGS. 1 and 3, the temporary-placement space 60 of the electric component unit 40 is formed between the top plate 52 and the internal plate 57 of the casing 29. This temporary-placement space 60 is opened on the front side by detaching the front wall 53 of the casing 29. When the electric component unit 40 is detached from the casing 29 for maintenance of the fan 17 or the like, the electric component unit 40 can be temporarily housed in the temporary-placement space 60. The provision of the above-described temporary-placement space 60 makes it unnecessary to separately assure a placement place of the electric component unit 40, and the electric component unit 40 detached from the casing 29 does not disturb the maintenance of the fan 17. Accordingly, maintenance work can be smoothly performed.

Since the electric component unit 40 detached from the casing 29 is housed in the temporary-placement space 60, electric wiring and the like connected to the electric component 42 are desirably formed long for allowance or configured so as to be able to be easily detached from the electric component unit 40. Moreover, the temporary-placement space 60 need not be able to house the whole electric component unit 40, but may house the electric component unit 40 in a state where a part of the electric component unit 40 sticks out from the casing 29.

The electric component case 41 functions as a part of each of the reinforcement members by being coupled to the upper and the lower reinforcement members 57, 58. That is, the electric component case 41 is configured as a strengthening member of the casing 29. Particularly, the electric component case 41 is constructed between the upper and the lower reinforcement members 57, 58, by which the electric component case 41 can receive a load in the vertical direction. Moreover, the electric component case 41 holds a relative position in the vertical direction and in the right-left direction of the upper and the lower reinforcement members 57, 58. This can restrain a rectangle formed by the right and the left side walls 55, 56, and the upper and the lower reinforcement members 57, 58 from being deformed so as to obliquely collapse (to incline into a parallelogram shape). Accordingly, the electric component case 41 can counteract the load in the right-left direction given to the casing 29, and preferably prevent the casing 29 from being deformed in directions where the right and the left side walls 55, 56 fall.

In this manner, the electric component case 41 is used as the strengthening member of the casing 29, which can increase strength of the casing 29 more. Moreover, since the electric component case 41 is formed into a box shape, and strength of the electric component case 41 itself is higher than that of a simple plate-shaped reinforcement member, the strength of the casing 29 can be further increased.

The electric component unit 40 may have a weight of about 10 to 15 kg, and when the electric component unit 40 is provided in an upper portion of the casing 29 as in the related art (refer to Patent Literature 1), a center of the gravity of the indoor unit 28 becomes high, thereby deteriorating stability. Particularly, since the indoor unit 28 includes the heat exchanging device 15 and the fan 17 side by side in the vertical direction, and has a structure elongated in the vertical direction, the high center of gravity easily impairs the stability. In this point, in the present embodiment, the electric component unit 40 is arranged in front of, and adjacent to the fan 17 in the intermediate stage portion in the vertical direction of the casing 29, and in other words, since at least a part of the electric component unit 40 is arranged so as to overlap the fan 17 in a horizontal direction, the center of gravity of the indoor unit 28 does not become so high, so that the stability can be sufficiently assured.

Figure 6:
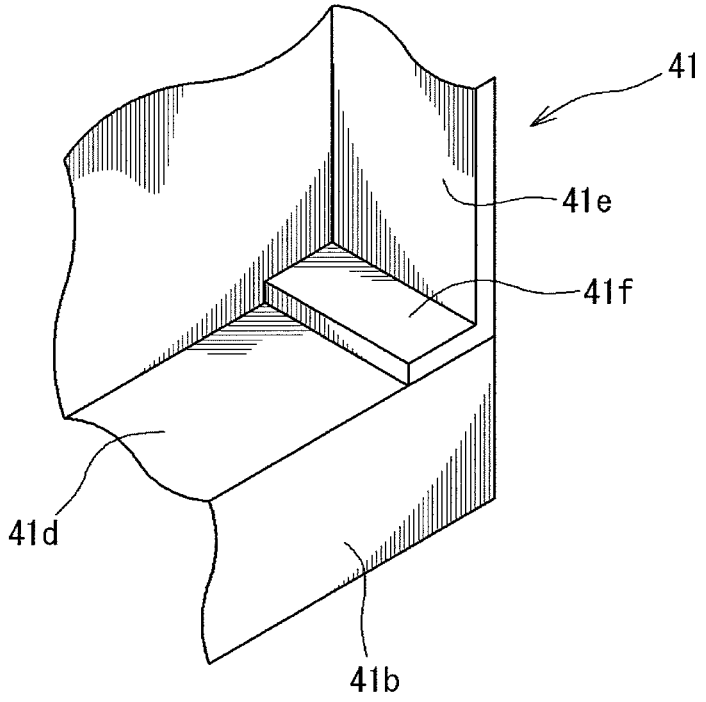
FIG. 6 is a perspective view showing a part of the electric component case in an enlarged manner.

FIG. 6 is a perspective view showing a part of the electric component case 41, and specifically, a joint portion between the bottom plate 41*d* and the side plate 41*e* of the electric component case 41 in an enlarged manner. At a lower end portion of each of the side plates 41*e* of the electric component case 41, a folded portion 41*f* bent inward at an angle of 90° is formed. These folded portions 41*f* are joined by welding or the like in a state placed on the bottom plate 41*d*, and the bottom plate 41*d* and the side plates 41*e* are in a surface contact. Therefore, for example, even if a load pushing up from below is applied to the bottom plate 41*d* of the electric component case 41 when the indoor unit 28 is placed on the ground or the like, the load can be received by the surface contact between the folded portions 41*f* and the bottom plate 41*d*. This prevents the side plates 41*e* from coming off the bottom plate 41*d*, which can increase the strength of the electric component case 41.

As shown in FIGS. 1 and 3, the electric component unit 40 is arranged in the circulation space of the air flow generated by the fan 17. This can promote cooling of the electric component 42 provided in the electric component unit 40. Particularly, when the fan 17 is inverter-controlled, since the electric component 42 includes a power element such as an IGBT and the like, which is a heat-generating component, the cooling of the heat-generating component can be preferably performed. As shown in FIG. 3, when a member for cooling 45 such as a cooling fin and the like is attached to the heat-generating component, the member for cooling 45 is protruded from the back plate 41*h* of the electric component case 41, which allows the heat-generating component to be more effectively cooled. Moreover, provision of openings or the like to circulate the air in the bottom plate 41*d*, the side plates 41*e* and the like of the electric component case 41 can further promote the cooling of the electric component 42 inside the electric component case 41.

The present invention is not limited to the above-described embodiment, and can be modified within a range of the invention described in claims as needed.

For example, while in the present embodiment, the heater 32 is provided in the exhaust passage 33 in the casing 29, this heater 32 can be omitted. However, the application of the present invention to the indoor unit 28 including the heater 32 allows the electric component 42 inside the electric component unit 40 to be arranged away from the heater 32, and can reduce influence of heat of this heater 32 on the electric component 42.

In the above-described embodiment, while an upper portion of the electric component case 41 is coupled to the internal plate 57, a reinforcement member different from this internal plate 57 may be constructed across the right and the left side walls 55, 56, and may be coupled to the upper portion of the electric component case 41.

The electric component case 41 may be formed in a range extending across the right and the left side walls 55, 56, and in this case, may be directly coupled to the side walls 55, 56.

The electric component supporting member 41 of the present invention need not be box-shaped, but as long as suitable water-resistance processing for the electric component 42 is applied, the electric component supporting member 41 may be formed into an open shape, such as a plate shape, or a frame shape.

The formation of the intake port 31 of the air in the casing 29 is not limited to the bottom plate 51, but the intake port 31 may be formed on a lower side of any of the side walls 53 to 56, and the formation of the exhaust port 30 of the air is not limited to the top plate 52, but the exhaust port 30 may be formed on an upper side of any of the side walls 53 to 56.

REFERENCE SIGNS LIST

15: Heat Exchanging Device
28: Indoor Unit
29: Casing
30: Exhaust Port
31: Intake Port
32: Heater
41: Electric Component Case (Electric Component Supporting Member)
41C: Locking Hook (Locking Portion)
41D: Bottom Plate
41E: Side Plate
41F: Folded Portion
42: Electric Component
53: Front Wall (First Side Wall)
55: Left Side Wall (Second Side Wall)
56: Right Side Wall (Third Side Wall)
57: Internal Plate (Reinforcement Member)
58: Reinforcement Member

The invention claimed is:

1. An indoor unit for an air conditioning device comprising:

a casing formed with an intake air port in a lower portion thereof, and an exhaust air port in an upper portion thereof;

a fan arranged inside the casing, and generating air flow from the intake air port to the exhaust air port;

a heat exchanger arranged below the fan inside the casing to exchange heat with the air taken into the casing from the intake air port; and an electric component case supporting an electric component; and an internal plate provided a distance below a top plate of the casing, the internal plate forming an internal space between it and the top plate sufficient for temporarily placing the electric component case when detached from the casing, wherein the electric component case is provided at a position adjacent to a lateral side of the fan in a circulation space of the air inside the casing, and is configured to counteract a load placed in a right-left direction on the casing, the casing includes a second side wall and a third side wall arranged to be opposed to each other, an upper reinforcement member and a lower reinforcement member spaced in a vertical direction are constructed across the second side wall and the third side wall, an upper portion and a lower portion of the electric component case are coupled to the upper reinforcement member and the lower reinforcement member, respectively, and wherein the internal plate is the upper reinforcement member.

2. The indoor unit for the air conditioning device according to claim 1, wherein a detachable first side wall is provided in one side surface of the casing, and the electric component case is accessible by detaching the first side wall, and the electric component case is detachable from the casing.

3. The indoor unit for the air conditioning device according to claim 1, wherein the electric component case is formed into a box shape.

4. The indoor unit for the air conditioning device according to claim 3, wherein the electric component case has a bottom plate and side plates extending upward from this bottom plate, and at a lower end of each of the side plates, a folded portion making a surface contact with an upper surface of the bottom plate is provided.

5. The indoor unit for the air conditioning device according to claim 1, wherein the electric component case includes a lock that locks the electric component case to the upper reinforcement member in a suspended state.

6. The indoor unit for the air conditioning device according to claim 1, wherein a heater is provided in the vicinity of the exhaust air port.

* * * * *